US008864274B2

(12) United States Patent
Higashiuchi

(10) Patent No.: US 8,864,274 B2
(45) Date of Patent: Oct. 21, 2014

(54) IMAGE FORMING APPARATUS

(71) Applicant: Konica Minolta, Inc., Chiyoda-ku (JP)

(72) Inventor: Hirokazu Higashiuchi, Toyokawa (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/922,440

(22) Filed: Jun. 20, 2013

(65) Prior Publication Data

US 2013/0342603 A1 Dec. 26, 2013

(30) Foreign Application Priority Data

Jun. 22, 2012 (JP) ..... 2012-141009

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 11/42*** | (2006.01) |
| *G03G 15/00* | (2006.01) |
| *G03G 15/23* | (2006.01) |

(52) U.S. Cl.

CPC ..... *B41J 11/42* (2013.01); *G03G 15/6544* (2013.01); *G03G 15/23* (2013.01); *B41J 13/0009* (2013.01); *G03G 15/5004* (2013.01)

USPC ..... 347/16; 347/104

(58) Field of Classification Search

CPC ..... B41J 15/5004; B41J 11/42; B41J 13/009

USPC ..... 347/16, 104

See application file for complete search history.

(56) References Cited

U.S. PATENT DOCUMENTS

| | | | | |
|---|---|---|---|---|
| 6,497,468 | B1 * | 12/2002 | Otsuka | 347/16 |
| 7,821,683 | B2 * | 10/2010 | Ito et al. | 358/496 |
| 2003/0169309 | A1 * | 9/2003 | Yokoyama | 347/14 |
| 2012/0106995 | A1 * | 5/2012 | Hirano | 399/45 |

FOREIGN PATENT DOCUMENTS

JP 2008-180899 A 8/2008

* cited by examiner

*Primary Examiner* — Julian Huffman

(74) *Attorney, Agent, or Firm* — Buchanan Ingersoll & Rooney PC

(57) ABSTRACT

An image forming apparatus transporting sheets of paper at a predetermined interval and forming an image on the sheets has, as modes for controlling the predetermined interval, a first mode of suspending a next paper feeding operation, for a predetermined time and for every predetermined number of sheets of paper and a second mode of expanding the interval of transportation between the paper feeding operations while continuing the transportation. The image forming apparatus decides whether a predefined first condition for starting control of the interval is satisfied during normal printing, determines a mode of the control in response to a decision that the condition is satisfied, and performs the control in the determined mode. The image forming apparatus calculates power consumption in each mode from the decision that the condition is satisfied to completion of uncompleted printing, and selects a mode in which the power consumption is relatively lower.

10 Claims, 17 Drawing Sheets

FIG.5

| TYPE OF PPM | CONDITION FOR EXECUTION OF PPM |
|---|---|
| DUPLEX TACKING PREVENTION PPM | NUMBER OF EJECTED SHEETS HAS REACHED N1 IN DUPLEX MODE |
| FIXING EDGE TEMPERATURE INCREASE PREVENTION PPM | TEMPERATURE DIFFERENCE BETWEEN FIXING CENTER TEMPERATURE SENSOR AND FIXING EDGE TEMPERATURE SENSOR REACHES T1 OR HIGHER |
| PU STICKING PREVENTION PPM | TEMPERATURE OF INTERIOR TEMPERATURE SENSOR REACHES T2 OR HIGHER |

FIG.9

| NUMBER OF SHEETS TO BE EJECTED AFTER CONDITION FOR EXECUTION OF PPM CONTROL IS MET | POWER CONSUMPTION (W) | | | |
|---|---|---|---|---|
| | MONOCHROME DUPLEX | | COLOR DUPLEX | |
| | PAPER INTERVAL EXPANSION | REACTIVATION | PAPER INTERVAL EXPANSION | REACTIVATION |
| 0 | 0 | 0 | 0 | 0 |
| 1 | **186** | **707** | **302** | **928** |
| 2 | **372** | **837** | **603** | **1139** |
| 3 | **557** | **967** | **905** | **1350** |
| 4 | **743** | **1097** | **1207** | **1562** |
| 5 | **929** | **1227** | **1509** | **1773** |
| 6 | **1115** | **1358** | **1810** | **1984** |
| 7 | **1301** | **1488** | **2112** | **2195** |
| 8 | **1487** | **1618** | 2414 | 2406 |
| 9 | **1672** | **1748** | 2715 | 2618 |
| 10 | **1858** | **1878** | 3017 | 2829 |
| 11 | 2044 | 2008 | 3319 | 3040 |
| 12 | 2230 | 2138 | 3621 | 3251 |
| 13 | 2416 | 2268 | 3922 | 3462 |
| 14 | 2602 | 2398 | 4224 | 3674 |
| 15 | 2787 | 2528 | 4526 | 3885 |
| 16 | 2973 | 2658 | 4827 | 4096 |
| 17 | 3159 | 2788 | 5129 | 4307 |
| 18 | 3345 | 2919 | 5431 | 4518 |
| 19 | 3531 | 3049 | 5733 | 4730 |
| 20 | 3717 | 3179 | 6034 | 4941 |
| 21 | 3902 | 3309 | 6336 | 5152 |
| 22 | 4088 | 3439 | 6638 | 5363 |
| 23 | 4274 | 3569 | 6939 | 5574 |
| 24 | 4460 | 3699 | 7241 | 5786 |
| 25 | 4646 | 3829 | 7543 | 5997 |
| 26 | 4832 | 3959 | 7845 | 6208 |
| 27 | 5017 | 4089 | 8146 | 6419 |
| 28 | 5203 | 4219 | 8448 | 6630 |
| 29 | 5389 | 4349 | 8750 | 6842 |
| 30 | 5575 | 4479 | 9051 | 7053 |

FIG.12

| | | |
|---|---|---|
| COLOR | SIMPLEX | 106W |
| | DUPLEX | 114W |
| MONOCHROME | SIMPLEX | 65W |
| | DUPLEX | 74W |

FIG.13

| | | |
|---|---|---|
| COLOR | SIMPLEX | 717W |
| | DUPLEX | 766W |
| MONOCHROME | SIMPLEX | 577W |
| | DUPLEX | 627W |

FIG.14

| NUMBER OF SHEETS TO BE EJECTED AFTER CONDITION FOR EXECUTION OF PPM CONTROL IS MET | POWER CONSUMPTION (W) | | | |
|---|---|---|---|---|
| | MONOCHROME DUPLEX | | COLOR DUPLEX | |
| | PAPER INTERVAL EXPANSION | REACTIVATION | PAPER INTERVAL EXPANSION | REACTIVATION |
| 0 | 0 | 0 | 0 | 0 |
| 1 | **260** | **1208** | **374.3** | **1427** |
| 2 | **520** | **1390** | **748.6** | **1689** |
| 3 | **780** | **1572** | **1123** | **1951** |
| 4 | **1040** | **1754** | **1497** | **2213** |
| 5 | **1300** | **1936** | **1871** | **2475** |
| 6 | **1560** | **2118** | **2246** | **2737** |
| 7 | **1820** | **2300** | **2620** | **2999** |
| 8 | **2080** | **2482** | **2994** | **3261** |
| 9 | **2340** | **2664** | **3369** | **3523** |
| 10 | **2600** | **2846** | **3743** | **3785** |
| 11 | **2860** | **3028** | 4117 | 4047 |
| 12 | **3120** | **3210** | 4491 | 4309 |
| 13 | **3380** | **3392** | 4866 | 4571 |
| 14 | 3640 | 3574 | 5240 | 4833 |
| 15 | 3900 | 3756 | 5614 | 5095 |
| 16 | 4160 | 3938 | 5989 | 5357 |
| 17 | 4420 | 4120 | 6363 | 5619 |
| 18 | 4680 | 4302 | 6737 | 5881 |
| 19 | 4940 | 4484 | 7111 | 6143 |
| 20 | 5200 | 4666 | 7486 | 6405 |
| 21 | 5460 | 4848 | 7860 | 6667 |
| 22 | 5720 | 5030 | 8234 | 6929 |
| 23 | 5980 | 5212 | 8609 | 7191 |
| 24 | 6240 | 5394 | 8983 | 7453 |
| 25 | 6500 | 5576 | 9357 | 7715 |
| 26 | 6760 | 5758 | 9731 | 7977 |
| 27 | 7020 | 5940 | 10106 | 8239 |
| 28 | 7280 | 6122 | 10480 | 8501 |
| 29 | 7540 | 6304 | 10854 | 8763 |
| 30 | 7800 | 6486 | 11229 | 9025 |

| | | |
|---|---|---|
| COLOR | SIMPLEX | 123W |
| | DUPLEX | 131W |
| MONOCHROME | SIMPLEX | 82W |
| | DUPLEX | 91W |

| | | |
|---|---|---|
| COLOR | SIMPLEX | 1116W |
| | DUPLEX | 1165W |
| MONOCHROME | SIMPLEX | 977W |
| | DUPLEX | 1026W |

FIG.22

| | | |
|---|---|---|
| CONDITION FOR EXECUTION OF PPM | COMMON | NUMBER OF EJECTED SHEETS HAS REACHED 50 IN DUPLEX MODE |
| PPM OPERATION | PAPER INTERVAL EXPANSION | EXPAND PAPER EJECTION INTERVAL FROM 2 s TO 4 s |
| | REACTIVATION | WAIT 150 s (INCLUDING LOAD INACTIVATION/ACTIVATION TIME) FOR EVERY 50 SHEETS. PAPER EJECTION INTERVAL AFTER CANCELLATION OF WAIT |

IMAGE FORMING APPARATUS

This application is based on Japanese Patent Application No. 2012-141009 filed with the Japan Patent Office on Jun. 22, 2012, the entire content of which is hereby incorporated by reference.

BACKGROUND OF THE INVENTION

1. Field of the Invention

The present invention relates to an image forming apparatus, a method for controlling an image forming apparatus, and a recording medium on which a control program for an image forming apparatus is recorded. In particular, the present invention relates to an image forming apparatus forming an image based on an electrophotographic process, a method for controlling the image forming apparatus, and a recording medium on which a control program for the image forming apparatus is recorded.

2. Description of the Related Art

One type of the conventional control of an image forming apparatus is PPM (Pages Per Minute) control, under which the image processing rate is controlled to thereby reduce the productivity.

PPM control aims, for example, to allow an adequate time for cooling ejected sheets of paper, and thereby prevent "duplex tacking," to reduce the frequency at which fixing heat is taken away by sheets of paper, and thereby prevent breakage of a fixing unit due to an increase in temperature of the edge of the fixing unit, and to allow an adequate time for cooling the inside of an image forming unit, and thereby prevent toner particles in the image forming unit from sticking together.

Generally employed methods for reducing the productivity under PPM control are:

1) a method by which the intervals between sheets of paper are increased by PPM control; and 2) a method by which printing is temporarily stopped (load is inactivated) and printing is resumed (load is activated) after standby for a predetermined time. Control 1) increases the intervals between sheets of paper, which prolongs the time for which the load is driven and accordingly increases power consumption. Therefore, in terms of power consumption, employment of Control 2) is considered more advantageous.

Control 2), however, still requires re-activation of the load after inactivation of the load and standby, which also prolongs the time for which the load is driven. Therefore, depending on what job is performed, above Control 1) may be able to reduce power consumption to a greater extent. Namely, although above Control 2) has conventionally been employed for reducing power consumption, there has been a problem that Control 2) may not actually be optimum control for reduction of power consumption.

SUMMARY OF THE INVENTION

The present invention has been made in view of the problem above, and an object of the invention is to provide an image forming apparatus whose power consumption can be reduced under PPM control, a method for controlling the image forming apparatus, and a recording medium on which a control program for the image forming apparatus is recorded.

In order to accomplish this object, an image forming apparatus according to an aspect of the present invention is an image forming apparatus for transporting sheets of paper at a predetermined interval and forming an image on the sheets of paper, and includes: a first decision unit for deciding whether a predefined first condition for starting control of the predetermined interval is satisfied; a determination unit for determining a mode of the control of the predetermined interval; and a control unit for performing the control of the predetermined interval in the mode determined by the determination unit, in response to a decision made by the first decision unit that the first condition is satisfied. The mode of the control includes a first mode of prolonging the predetermined interval by suspending a next paper feeding operation, for a predetermined time and for every predetermined number of sheets of paper, and a second mode of prolonging the predetermined interval by expanding the interval of transportation between the paper feeding operations while continuing the transportation. The image forming apparatus further includes a first calculation unit for calculating power consumption in each mode from the decision that the first condition is satisfied to completion of uncompleted printing, and the determination unit is configured to select a mode in which the power consumption calculated by the first calculation unit is relatively lower.

Preferably, the determination unit is configured to select the second mode when the number of remaining sheets of paper to be printed after the decision that the first condition is satisfied is less than a predetermined number, and configured to select the first mode when the number of remaining sheets of paper is the predetermined number or more.

Preferably, a postprocessing apparatus is attachable to the image forming apparatus. In response to the decision that the first condition is satisfied with the postprocessing apparatus attached to the image forming apparatus, the first calculation unit is configured to calculate, as the power consumption in each mode from the decision that the first condition is satisfied to completion of uncompleted printing, the power consumption to which power consumption of the postprocessing unit is added.

Preferably, the first condition includes a condition that a predetermined number or more of printed sheets of paper have been ejected on the same paper ejection tray in a duplex printing mode.

Preferably, the first condition includes a condition that a predetermined number or more of sheets of paper whose length in a main scanning direction is shorter than a predetermined value have successively been printed.

Preferably, the first condition includes a condition that an interior temperature of the image forming apparatus has reached a predetermined value during successive printing.

Preferably, the image forming apparatus further includes a second decision unit for deciding whether a predefined second condition for ending the control of the predetermined interval is satisfied. In response to a decision made by the second decision unit that the second condition is satisfied, after start of the control of the predetermined interval, the control unit is configured to end the control of the predetermined interval and the first decision unit is configured to decide whether the first condition is satisfied.

Preferably, the image forming apparatus further includes a second calculation unit for calculating a printing time in each mode required from the decision that the first condition is satisfied to completion of uncompleted printing. The determination unit is configured to select a mode in which the printing time is relatively shorter in response to that a third condition is satisfied and select a mode in which the power consumption is relatively lower in response to that the third condition is not satisfied, the third condition being that a difference, between the first mode and the second mode, of the printing time calculated by the second calculation unit is a predetermined value or more which is set in advance, and a difference, between the first mode and the second mode, of the power consumption calculated by the first calculation unit is less than a predetermined value which is set in advance.

According to another aspect of the present invention, a method for controlling an image forming apparatus is a method for controlling the image forming apparatus so that the image forming apparatus transports sheets of paper at a predetermined interval and forms an image on the sheets of paper. The image forming apparatus has, as modes for controlling the predetermined interval, a first mode of prolonging the predetermined interval by suspending a next paper feeding operation, for a predetermined time and for every predetermined number of sheets of paper, and a second mode of prolonging the predetermined interval by expanding the interval of transportation between the paper feeding operations while continuing the transportation. The method for controlling the image forming apparatus includes: deciding whether a predefined condition for starting control of the predetermined interval is satisfied during normal printing; determining a mode of the control of the predetermined interval in response to a decision that the condition is satisfied; and performing the control of the predetermined interval in the determined mode. The determining a mode includes calculating power consumption in each mode from the decision that the condition is satisfied to completion of uncompleted printing, and selecting a mode in which the power consumption is relatively lower.

According to still another aspect of the present invention, a non-transitory computer-readable storage medium stores a control program for causing a controller of an image forming apparatus to execute a process of transporting sheets of paper at a predetermined interval and forming an image on the sheets of paper. The image forming apparatus has, as modes for controlling the predetermined interval, a first mode of prolonging the predetermined interval by suspending a next paper feeding operation, for a predetermined time and for every predetermined number of sheets of paper, and a second mode of prolonging the predetermined interval by expanding the interval of transportation between the paper feeding operations while continuing the transportation. The control program causes the controller of the image forming apparatus to perform: deciding whether a predefined condition for starting control of the predetermined interval is satisfied during normal printing; determining a mode of the control of the predetermined interval in response to a decision that the condition is satisfied; and performing the control of the predetermined interval in the determined mode. The determining a mode includes calculating power consumption in each mode from the decision that the condition is satisfied to completion of uncompleted printing, and selecting a mode in which the power consumption is relatively lower.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 is a diagram showing conditions for execution of PPM control.

FIG. 9 is a diagram showing a specific example of a power consumption transition table.

FIG. 12 is a diagram showing a specific example of a power consumption table in which power consumption is defined that is required for separating sheets of paper from each other for simplex printing and duplex printing in each of color printing and monochrome printing.

FIG. 13 is a diagram showing a specific example of a power consumption table in which power consumption is defined that is required for stopping loads for simplex printing and duplex printing in each of color printing and monochrome printing.

FIG. 14 is a diagram showing a specific example of a power consumption transition table in which the power consumption additionally includes the power consumption of the post-processing apparatus FS.

FIG. 22 is a diagram showing a specific example of a condition for execution of PPM control and a control condition in each PPM mode.

DESCRIPTION OF THE PREFERRED EMBODIMENTS

Figure 1:
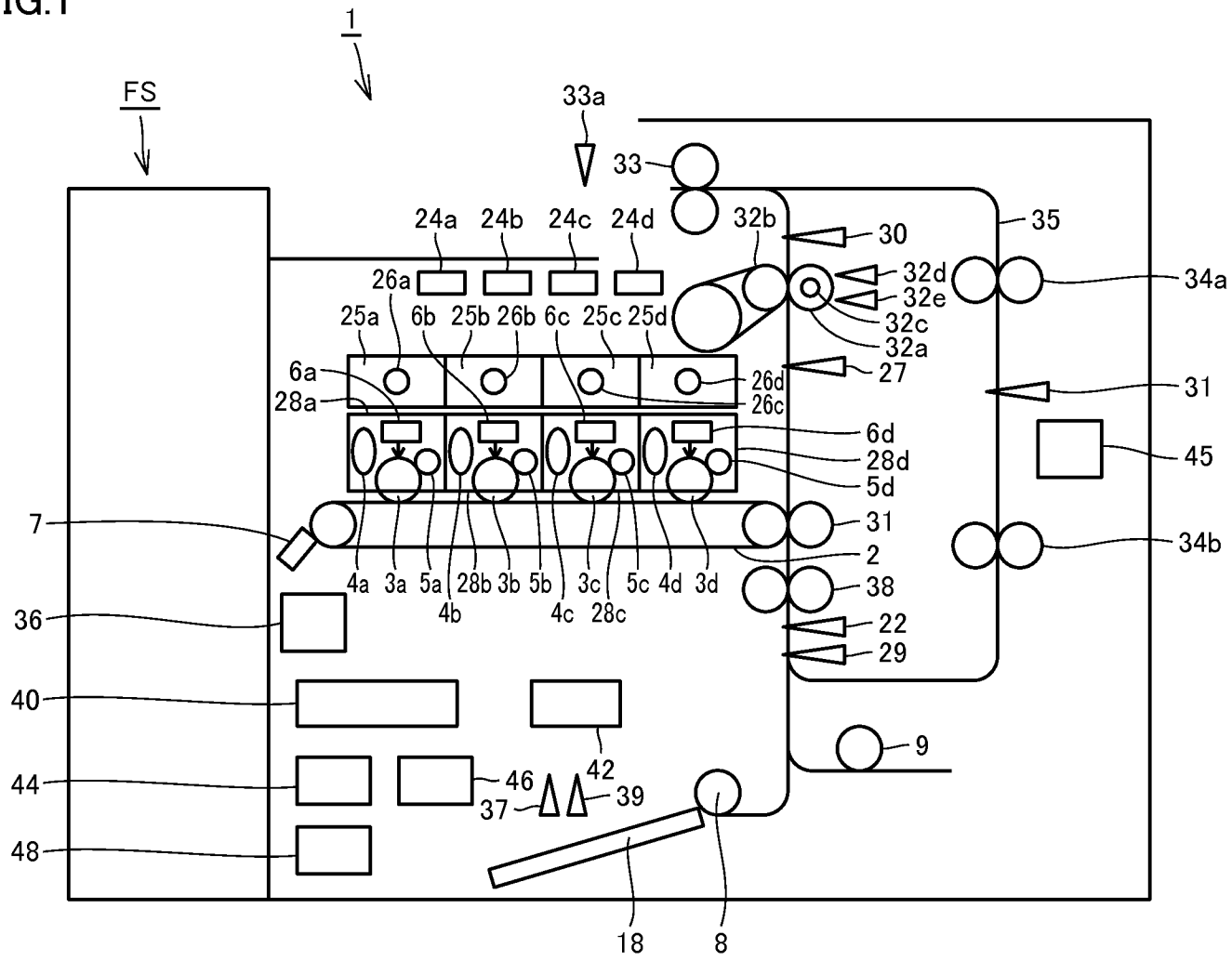
FIG. 1 is a schematic cross section of an image processing apparatus in an embodiment.

Embodiments of the present invention will hereinafter be described with reference to the drawings. In the following description, the same parts/components are denoted by the same reference characters. They are named and function identically as well. Therefore, a detailed description thereof will not be repeated.

<Apparatus Configuration>

FIG. 1 is a schematic cross section of an image processing apparatus in the present embodiment. The image processing apparatus includes a postprocessing apparatus (sheet finishing system) FS and an image forming apparatus 1.

Image Forming Apparatus

Image forming apparatus 1 is herein a tandem color printer by way of example.

Further, referring to FIG. 1, image forming apparatus 1 which is the tandem color printer has a tandem transfer unit to successively superimpose toner of four colors, namely yellow (Y), magenta (M), cyan (C), and black (K) on each other and accordingly form a color image. In FIG. 1, respective groups of components corresponding to yellow (Y), magenta (M), cyan (C), and black (K) are identified by a, b, c, and d, respectively.

Image forming apparatus 1 as shown in FIG. 1 uses a development device 4 to develop an electrostatic latent image which has been formed on a photoreceptor 3 through exposure by an exposure device 6. Image forming apparatus 1 uses a primary transfer roller (not shown) to transfer the resultant toner image onto an intermediate transfer belt 2 and further transfer it onto recording paper.

Specifically, image forming apparatus 1 includes cartridges (imaging units) 28 of four colors: Y, M, C, K arranged in tandem. Toner images of respective colors formed by these cartridges 28 are transferred so that they are superimposed on each other into a composite image on intermediate transfer belt 2.

Each cartridge 28 includes the development device 4, a charging device 5, and the exposure device 6 for example that are arranged in the vicinity of the drum-shaped photoreceptor 3. The surface of photoreceptor 3 is charged by charging device 5 to a predetermined voltage (charge potential) V0, and an electrostatic latent image is formed by exposure to light from exposure device 6. A development roller, to which a development bias voltage Vdc is applied, supplies the electrostatic latent image, which has a potential gap ΔV from development bias voltage Vdc, with toner and thus the electrostatic latent image is made visible into a toner image.

The toner image which has been made visible on the surface of photoreceptor 3 is primarily transferred by the primary transfer roller to intermediate transfer belt 2. The toner image on the intermediate transfer belt 2 is secondarily transferred, by a secondary transfer roller 31, to recording paper which has been transported from a paper feed unit 18 containing recording media through a cassette paper feed roller 8. The recording paper transported through cassette paper feed roller 8 is temporarily stopped as required by a timing roller 38. Further, a manual paper feed roller 9 is provided for transporting recording paper to timing roller 38 in the case where the recording paper is manually fed. A paper detection sensor 29 is placed upstream relative to timing roller 38, and timing control is performed in accordance with an output from the detection sensor. A paper quality detection sensor 22 is also provided for determining whether the paper is thick paper, plain paper, or the like. The output of paper quality detection sensor 22 is given to an engine control unit 152, which will be described later herein, and engine control unit 152 sets the transport speed (system speed) for transporting the recording paper, in accordance with the output of paper quality detection sensor 22. More specifically, when thick paper is detected, the transport speed (system speed) for the recording paper is slowed down to half the normal speed, for such a reason that fixing of the image to the thick paper takes a longer time relative to plain paper. Namely, where the speed for plain paper is a full speed, the speed for thick paper is a half speed. Regarding the present example, it has been described by way of example that the transport speed (system speed) for recording paper is varied depending on whether the paper is plain paper or thick paper. The transport speed is not particularly limited to this, and the transport speed for recording paper may be varied depending on a variety of modes.

The toner image which has secondarily been transferred onto the recording paper is fixed by a fixing roller 32*a*. A pressure roller 32*b* is provided to face and contact fixing roller 32*a*. In the vicinity of fixing roller 32*a*, a temperature sensor is provided for detecting the surface temperature of fixing roller 32*a*, and a fixing heater 32*c* is provided in fixing roller 32*a* for heating fixing roller 32*a*. As the above-described temperature sensor, a fixing edge temperature sensor 32*d* for detecting the temperature of the edge region of fixing roller 32*a* and a fixing center temperature sensor 32*e* for detecting the temperature of the center region thereof are used. A fixing loop sensor 27 is placed upstream relative to fixing roller 32*a*, for detecting a loop occurring to the paper by fixing roller 32*a* and the transfer unit located near secondary transfer roller 31.

The recording paper on which the image has been fixed is ejected by a paper ejection roller 33 onto a paper exit tray or sent to the postprocessing apparatus FS. The recording paper on which the image has been fixed may be transported to a duplex transport path 35. In the vicinity of an exit outlet, an exit outlet sensor 33*a* is provided for detecting whether or not paper is present on the paper exit tray.

Duplex transport path 35 continues to the path which leads to above-described timing roller 38. On duplex transport path 35, duplex transport rollers 34*a*, 34*b* are provided. A duplex transport motor 45 drives these duplex transport rollers 34*a*, 34*b* to thereby transport recording paper on duplex transport path 35 to timing roller 38.

Toner which is left untransferred in the above-described secondary transfer process and thus remains on intermediate transfer belt 2 (untransferred remaining toner) is removed by an intermediate transfer belt cleaner 7 and collected. Namely, after the secondary transfer process, the surface of intermediate transfer belt 2 is cleaned by intermediate transfer belt cleaner 7. The present embodiment uses, as intermediate transfer belt cleaner 7, a cleaning-blade-type cleaner configured to be movable to be pressed against and separated from intermediate transfer belt 2. Instead, any of a variety of types or mechanisms of cleaners may be used, such as a brush-type cleaner for which a voltage applied to intermediate transfer belt 2 is controlled to be ON and OFF. The untransferred remaining toner is collected in a waste toner box 36.

Above cartridge 28, a toner bottle 25 is provided for feeding toner by operating a stirring blade 26 for the sake of replenishment. Toner replenishment motors 24*a*, 24*b*, 24*c*, 24*d* are provided for operating stirring blades 26*a*, 26*b*, 26*c*, 26*d*, respectively.

A color PC motor 48 for rotating photoreceptor 3 in the color cartridge, a main motor 44, a fixing motor 46, a color development motor 40, and a development motor 42 are also provided.

Moreover, the interior of image forming apparatus 1 is mounted with an interior temperature sensor 37 for detecting the interior temperature and an interior humidity sensor 39 for detecting the interior humidity.

Postprocessing Apparatus FS

Figure 2:
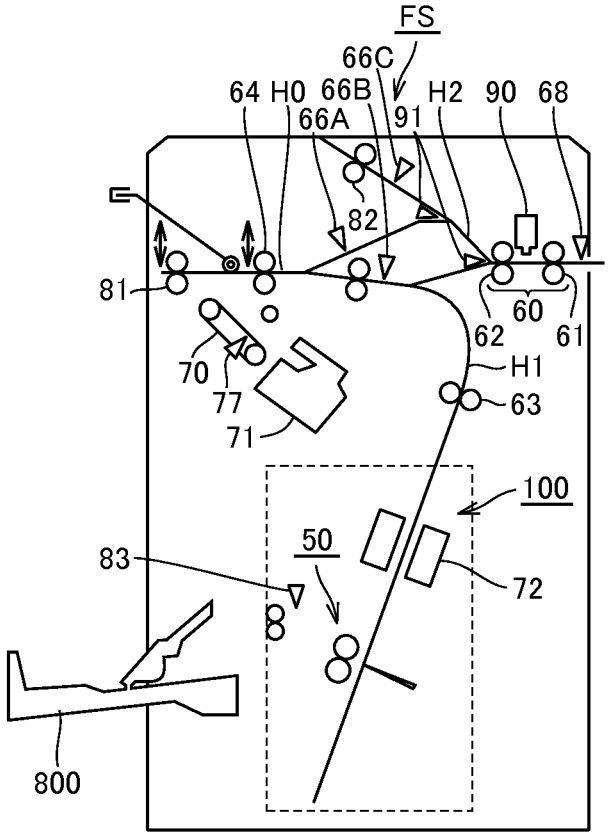
FIG. 2 is a schematic cross section of a postprocessing apparatus included in the image processing apparatus.

FIG. 2 is a schematic cross section of postprocessing apparatus FS.

Referring to FIG. 2, postprocessing apparatus FS includes a paper loading unit 60 for transporting paper in postprocessing apparatus FS, and a plurality of postprocessing units. The postprocessing units include a punching unit 90, a folding unit 50, an edge stitching (side stitching: stapling) unit 71, a saddle stitching unit 72, and a paper ejection unit for ejecting paper onto a stack tray.

Recording paper on which an image has been formed and which has been sent from paper ejection roller 33 of image forming apparatus 1 to postprocessing apparatus FS is transported to the inside of postprocessing apparatus FS by a registration roller 61 placed near an inlet of postprocessing apparatus FS and an intermediate roller 62 placed on the left downstream side of registration roller 61 that are included in paper loading unit 60.

Punching unit 90 is placed between registration roller 61 and intermediate roller 62 to punch a hole in recording paper. Specifically, a pre-registration sensor 68 is placed on the right upstream side relative to registration roller 61 located near the inlet of postprocessing apparatus FS. When recording paper is loaded in postprocessing apparatus FS, pre-registration sensor 68 detects loading of the recording paper. Then, after a predetermined time from detection of loading of the recording paper, transportation of the recording paper is stopped and punching unit 90 punches a hole in the recording paper (punching).

The path on the downstream side of punching unit 90 is branched into three transport paths H0, H1, H2. Transport paths H0, H1, H2 are switched by a transport path switch member 91. Transport path H1, which is a downward branch, extends through a saddle loading roller 63 into a saddle 100. Saddle 100, which will be described later herein, includes saddle stitching unit 72 and folding unit 50. Details will be given below.

Transport path H0 extends through a transport roller 64 and further extends from a first tray ejection roller 81 to an elevate tray (first tray) (not shown) placed at an outlet located on the upper left side of postprocessing apparatus FS.

Transport path H2 extends through a second tray ejection roller 82 included in the paper ejection unit to a second tray (not shown) placed at an upper outlet of postprocessing apparatus FS.

When many sheets of paper are ejected without processing by the postprocessing unit, recording sheets of paper are transported in postprocessing apparatus FS from paper loading unit 60 through transport path H0 and further from first tray ejection roller 81 of the paper ejection unit to an elevate tray 800 placed at an outlet of postprocessing apparatus FS.

Elevate tray 800 moves downward so that the topmost position of ejected sheets of recording paper is kept at a certain height all the time. Therefore, on elevate tray 800, thousands of sheets of recording paper can be stacked.

On these transport paths, an upper path sensor 66A for detecting passage of recording paper through transport path H0, a lower path sensor 66B for detecting passage of recording paper through transport path H1, and a second tray path sensor 66C for detecting passage of recording paper through transport path H2 are arranged. Based on detection by these sensors, timing for driving each transport roller, for example, is executed.

Further, first tray ejection roller 81 is movable into a pressed state and a separated state. When first tray ejection roller 81 is in the pressed state, recording paper is ejected onto elevate tray 800 as described above. In contrast, when first tray ejection roller 81 is in the separated state, the recording paper is not immediately ejected onto elevate tray 800. Instead, after the recording paper reaches first tray ejection roller 81, the rear end of the recording paper falls on a receiving belt 70. Receiving belt 70 rotates to transport the sheet of paper toward the location of edge stitching unit 71. The above process is performed multiple times for a plurality of sheets of recording paper. When a processing tray paper detection sensor 77 detects that a predetermined number of sheets have been received in edge stitching unit 71, edge stitching is started. After this, receiving belt 70 transports, toward first tray ejection roller 81, a bundle of sheets of recording paper whose edges are stitched together, and the bundle of sheets of recording paper is ejected from first tray ejection roller 81 onto elevate tray 800.

Saddle 100 is placed downstream of saddle loading roller 63 and obliquely relative to the horizontal direction. Saddle 100 includes a plurality of guide members for guiding recording paper and an end stopper, saddle stitching unit 72, folding unit 50, and a paper width registration unit. Saddle 100 performs saddle stitching on one or more sheets of recording paper and ejects it/them on elevate tray 800. The sheets of paper ejected on elevate tray 800 are detected by ejection sensor 83.

Figure 3:
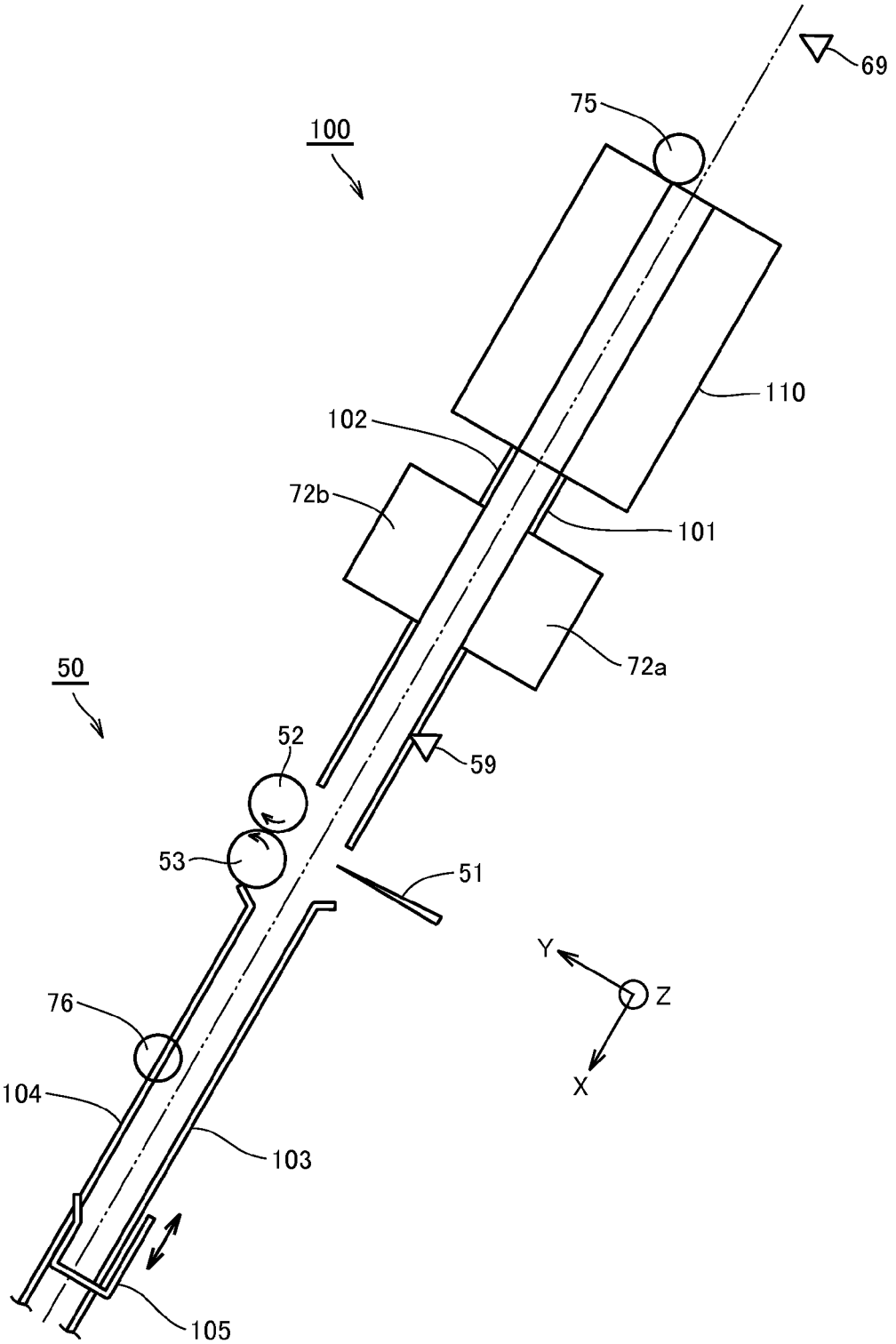
FIG. 3 is an enlarged cross section of main components of a saddle in the postprocessing apparatus.

FIG. 3 is an enlarged cross section of main components of saddle 100 in postprocessing apparatus FS.

Referring to FIG. 3, recording paper is loaded from obliquely above in an obliquely downward direction. As shown in a lower right portion of FIG. 3, the following description identifies the obliquely downward direction as X direction, the direction orthogonal to the X direction on the plane of FIG. 3 as Y direction, and the direction perpendicular to the plane of FIG. 3 as Z direction.

The guide members which are constituent parts of saddle 100 include upstream guide members 101, 102 and downstream guide members 103, 104. On the upper side of upstream guide members 101, 102, paper width registration unit 110 is located. At a substantially middle position of upstream guide members 101, 102, saddle stitching unit 72 is located. Between upstream guide members 101, 102 and downstream guide members 103, 104, folding unit 50 is located.

Sheets of recording paper loaded through transport path H1 into saddle 100 are detected one by one by a saddle loading unit sensor 69. The loaded recording paper is conveyed by its own weight along the guide members. At this time, an upper paddle 75 and a lower paddle 76 rotate while contacting the surface of the recording paper to thereby smoothly transport sheets of recording paper one by one.

Paper width registration unit 110 registers sheets of recording paper with respect to the direction of the width (Z direction, anti-Z direction).

On the downstream side of folding unit 50, end stopper 105 that is movable along downstream guide members 103, 104 is placed. End stopper 105 regulates the bottom end of recording paper so that the bottom end is located at a predetermined position, and is moved depending on the paper size.

Upstream guide member 101 and downstream guide member 103 are located on the lower side (in the anti-Y direction) of saddle 100, and form a stack plane along which sheets of recording paper slide down and are stacked. Upstream guide member 102 and downstream guide member 104 are placed opposite to upstream guide member 101 and downstream guide member 103, respectively, with a certain distance kept therebetween.

Saddle stitching unit 72 includes a staple receiving mechanism 72*a* and a stapling mechanism 72*b*. Saddle stitching unit 72 starts to operate in response to positioning of the central portion, with respect to the paper transport direction, of a bundle of sheets of recording paper by end stopper 105, to saddle-switch the bundle of sheets of recording paper. Specifically, end stopper 105 moves in the recording-paper transport direction (X direction, anti-X direction) and accordingly a plurality of sheets of recording paper are stacked so that respective centers are located at saddle stitching unit 72. After a plurality of sheets of recording paper are stacked, the bundle of sheets of recording paper is saddle-stitched by saddle stitching unit 72. In the case where saddle stitching unit 72 does not perform saddle stitching, sheets of recording paper are stacked so that respective centers are located at folding unit 50. The position of the recording paper is detected by a saddle tray sensor 59.

Folding unit 50 includes a folding plate (folding knife) 51, a first folding roller 52, and a second folding roller 53. Folding unit 50 folds recording paper in the form of half fold (folds at the center).

Figure 4:
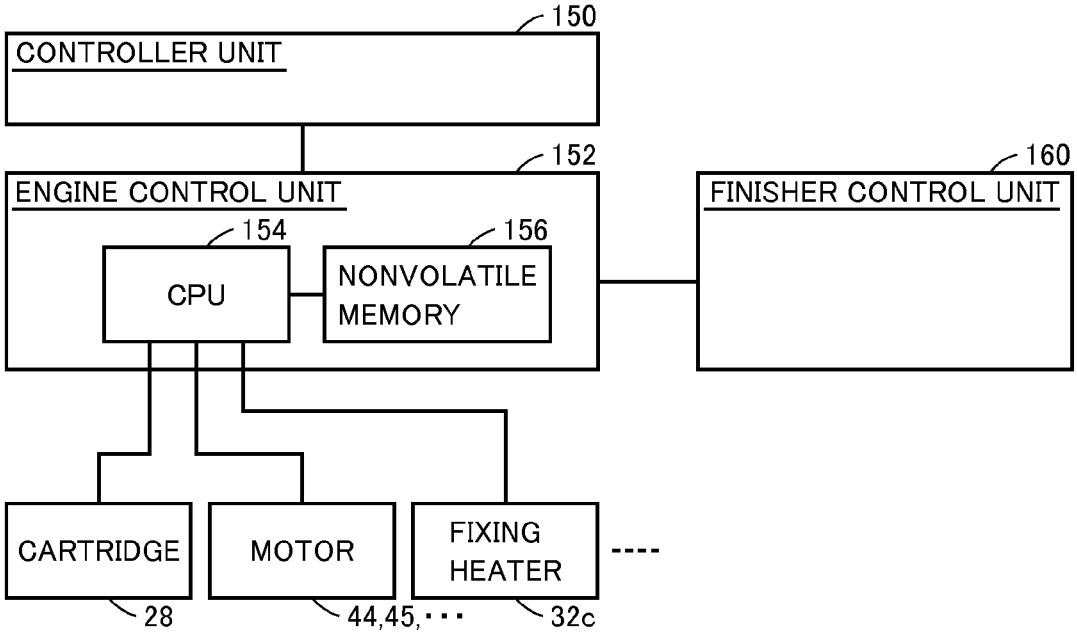
FIG. 4 is a block diagram showing a control configuration of an image forming apparatus included in the image processing apparatus.

FIG. 4 is a block diagram showing a control configuration of image forming apparatus 1.

Referring to FIG. 4, image forming apparatus 1 includes a controller unit 150 for controlling the whole of image forming apparatus 1, an engine control unit 152, and a finisher control unit 160 for controlling postprocessing apparatus FS.

Engine control unit 152 includes a CPU (Central Processing Unit) 154 for executing control and a nonvolatile memory 156 in which a variety of programs are stored. CPU 154 is connected to a variety of loads such as cartridge 28 (print head) for forming an image, motors 44, 45 for transporting paper, and fixing heater 32*c*, and reads a program stored in nonvolatile memory 156 to thereby execute control of these loads.

Engine control unit 152 and controller unit 150 are connected to each other and communicate necessary information when, for example a request for printing is made by a user. Job information and the like, which will be described later herein, is also managed by controller unit 150. Engine control unit 152 makes an inquiry to controller unit 150 to thereby obtain the information.

Further, to engine control unit 152, finisher control unit 160 is connected. Receiving a request for post processing from controller unit 150, engine control unit 152 transmits information to finisher control unit 160.

<Operation Overview>

Image forming apparatus 1 in the present embodiment executes PPM (Pages Per Minute) control.

A first reason why image forming apparatus 1 performs PPM control is as follows. Namely, duplex printing requires both the front side and the back side of a sheet of paper to be passed through the fixing, which results in an increase in temperature of the sheet of paper and accordingly causes sheets of paper on the paper exit tray to stick to each other. This phenomenon is called "duplex tacking." PPM control increases the interval at which sheets of paper are ejected to thereby prevent this duplex tacking. PPM control for the purpose of preventing duplex tacking will also be referred to hereinafter as "duplex tacking prevention PPM."

A second reason why image forming apparatus 1 performs PPM control is as follows. Namely, in the case where sheets of recording paper having a narrow width are printed successively, the sheets of paper are not passed on the edge region of the fixing roller and thus the temperature of the edge region increases. The increased temperature causes the fixing unit to be broken. PPM control is performed to increase the interval at which sheets of paper are ejected to thereby prevent this increase in temperature. PPM control for the purpose of preventing an increase of the temperature of the edge region of the fixing roller will also be referred to hereinafter as "fixing edge temperature increase prevention PPM."

A third reason why image forming apparatus 1 performs PPM control is as follows. Namely, in the case of duplex printing, fixing heat for printing the back side may be transmitted through the transfer belt to the inside of the cartridge (PU) to thereby cause the inside of the cartridge to have a high temperature. The high temperature in the cartridge causes toner particles in the cartridge to melt and stick together. PPM control is performed to increase the interval at which printing is done, and thereby prevent this increase in temperature. PPM control for the purpose of preventing toner particles in the cartridge (PU) from sticking together will also be referred to hereinafter as "PU sticking prevention PPM."

FIG. 5 is a diagram showing conditions for execution of each type of PPM control.

Referring to FIG. 5, a first condition is as follows. On the condition that the number of sheets ejected on the same tray in the duplex mode has reached a predefined number N1 (50 sheets for example), image forming apparatus 1 performs "duplex tacking prevention PPM."

A second condition is as follows. On the condition that a difference between the temperature of the edge region of fixing roller 32*a* detected by fixing edge temperature sensor 32*d* and the temperature of the central region of fixing roller 32*a* detected by fixing center temperature sensor 32*e* has reached a predefined temperature T1 (10° C. for example) or higher, image forming apparatus 1 performs "fixing edge temperature increase prevention PPM."

A third condition is as follows. On the condition that the interior temperature detected by interior temperature sensor 37 has reached a predefined temperature T2 (40° C. for example) or higher, image forming apparatus 1 performs "PU sticking prevention PPM."

Image forming apparatus 1 has a plurality of modes, as modes of PPM control, including a control mode of increasing the interval at which sheets of paper are ejected (hereinafter paper interval expansion mode), and a mode of temporarily stopping printing (load inactivation) and thereafter resuming printing (load activation) after standby for a predetermined time (hereinafter reactivation mode).

Figure 6:
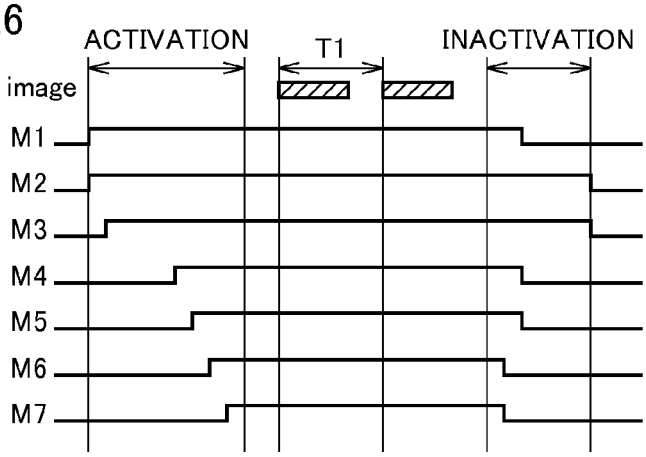
FIG. 6 is a diagram showing respective driving states of motors in the case where two sheets of paper are successively printed in a normal printing process.
Figure 7:
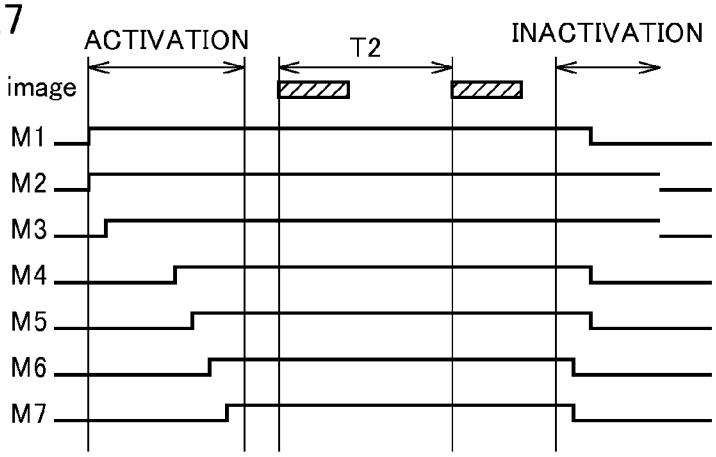
FIG. 7 is a diagram showing respective driving states of motors in the case where two sheets of paper are successively printed in a paper interval expansion mode.
Figure 8:
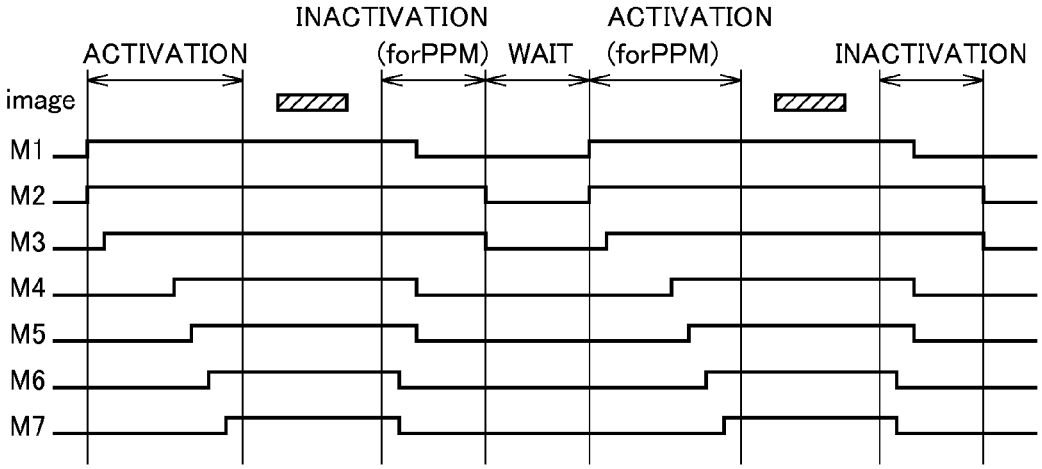
FIG. 8 is a diagram showing respective driving states of motors in the case where two sheets of paper are successively printed in a reactivation mode.

FIGS. 6 to 8 are diagrams for illustrating PPM control modes, and show respective driving states of motors when image forming apparatus 1 prints two sheets of paper successively in a normal printing process, in the paper interval expansion mode, and the reactivation mode, respectively. In these drawings, "image" indicates the timing at which image formation is done on recording paper, and the hatched strip-like portion represents a period of time for which image formation is done. M1 to M7 represent, respectively, a motor which is used for forming an electrostatic latent image on photoreceptor 3 by exposure device 6 (such as polygon motor), main motor 44, a sub motor, color PC motor 48, a black PC motor, color development motor 40, and development motor 42.

Referring to FIG. 6, in the case of the normal printing, the motors start operating in sequence, in response to the start of printing. After all the loads are activated, the motors perform image formation on recording paper in sequence at a time interval T1. When image formation on all sheets of recording paper (two sheets in this example) is completed, the motors stop operating and all the loads are inactivated.

Referring to FIG. 7, in the paper interval expansion mode, all the loads are activated similarly to the normal printing, and thereafter the motors perform image formation on recording paper in sequence at a time interval T2 longer than image formation interval T1 for the normal printing (T2>T1). Then, when image formation on all sheets of recording paper (two sheets in this example) is completed, the motors stop operating and all the loads are inactivated.

Time interval T2 varies depending on the type of PPM control and is herein determined in advance through an experiment or the like. For example, where time interval T1 for the normal printing is 2 [sec], respective time intervals for different types of PPM control may approximately be as follows. Namely, the time interval for the duplex tacking prevention PPM may be 4 [sec], the time interval for the fixing edge temperature increase prevention PPM may be 3 [sec], and the time interval for the PU sticking prevention PPM may be 8 [sec].

Referring to FIG. 8, in the reactivation mode, after all the loads are activated similarly to the normal printing, image formation on a first sheet of paper is done and thereafter all the loads are temporarily inactivated. Then, for a predefined standby time (WAIT), all the loads are kept stopped. The activation of all the loads, image formation, inactivation of all the loads, and standby are repeated for every single sheet of recording paper.

The standby time (WAIT) varies depending on the type of PPM control and is herein determined in advance through an experiment or the like. For example, the standby time may approximately be as follows. Namely, the standby time for the duplex tacking prevention PPM may be 150 [sec], the standby time for the fixing edge temperature increase prevention PPM may be 5 [sec], and the standby time for the PU sticking prevention PPM may be 120 [sec].

When a condition for execution of PPM control (condition for execution) is satisfied in a printing process, engine control unit 152 of image forming apparatus 1 determines the mode of PPM control to be executed, based on unprocessed jobs (uncompleted jobs). More specifically, image forming apparatus 1 calculates, for each mode, the value of electric power (amount of power consumption) that is required for completing printing of uncompleted jobs, and selects a mode in which the value of electric power is relatively smaller, as a mode to be executed.

The value of electric power required for completing printing of uncompleted jobs in the paper interval expansion mode is the value of electric power that is required from the start in this mode to completion of printing. The value of electric power that is required for completing printing of uncompleted jobs in the reactivation mode is the sum of the value of electric power consumed for stopping the loads and reactivating the loads, the value of electric power required for the temperature of the fixing unit to reach a printable temperature, and the value of electric power required from the start in this mode after activation, to completion of printing.

The value of electric power is calculated in the following manner by way of example. Namely, the power consumption according to the number of uncompleted jobs in each mode is measured in advance through an experiment or the like, and a power consumption transition table prepared based on the measurements is used.

FIG. 9 is a diagram showing a specific example of the power consumption transition table.

Referring to FIG. 9, in the power consumption transition table, the power consumption in the paper interval expansion mode and the power consumption in the reactivation mode are registered for each of monochrome duplex printing and color duplex printing, for each number of sheets that are to be ejected after a condition for executing PPM control is satisfied.

Figure 10:
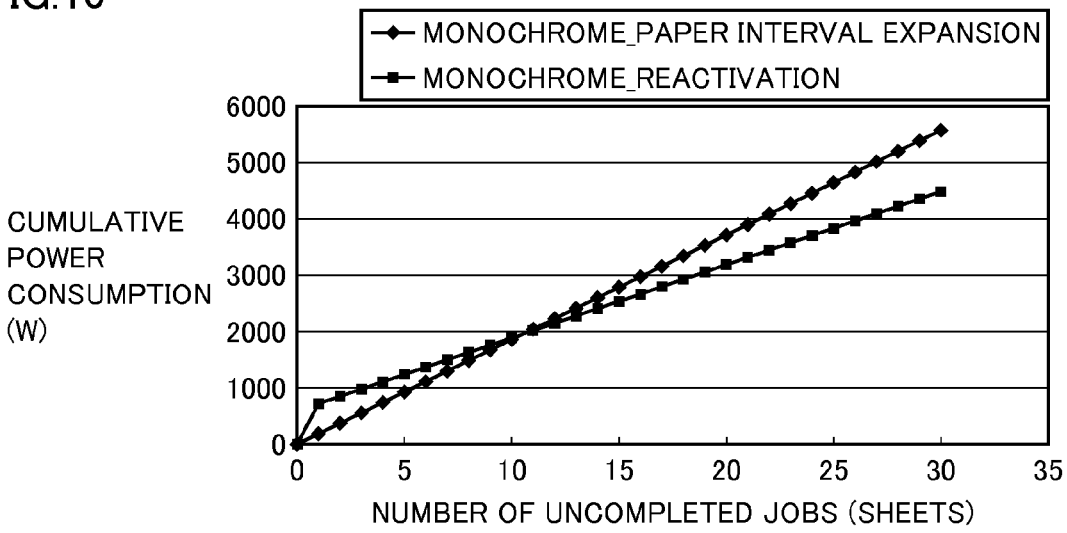
FIG. 10 is a diagram showing a relation, based on FIG. 9, between the number of uncompleted jobs (number of sheets of paper to be ejected after a condition for execution is satisfied) and power consumption in each mode in the case of monochrome duplex printing.
Figure 11:
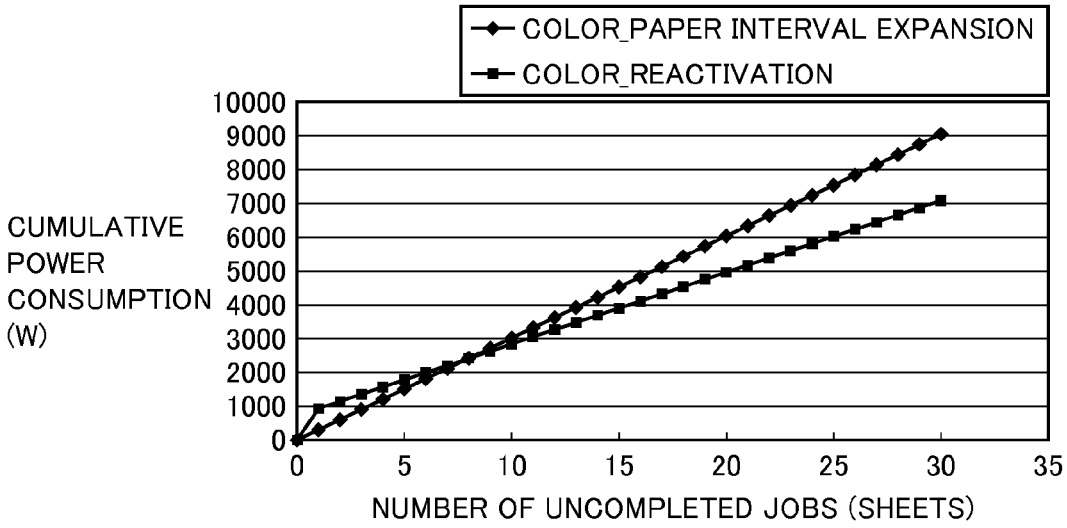
FIG. 11 is a diagram showing a relation, based on FIG. 9, between the number of uncompleted jobs (number of sheets of paper to be ejected after a condition for execution is satisfied) and power consumption in each mode in the case of color duplex printing.

FIG. 10 is a diagram showing a relation, based on FIG. 9, between the number of uncompleted jobs (number of sheets of paper to be ejected after a condition for execution of PPM control is satisfied) and power consumption in each mode in the case of monochrome duplex printing. FIG. 11 is a diagram showing a relation, based on FIG. 9, between the number of uncompleted jobs (number of sheets of paper to be ejected after a condition for execution of PPM control is satisfied) and power consumption in each mode in the case of color duplex printing.

It is seen from FIGS. 9 and 10 that, in the case of monochrome duplex printing, the power consumption in the paper interval expansion mode is smaller than that in the reactivation mode when the number of uncompleted jobs is ten or less, while the power consumption in the paper interval expansion mode is larger than that in the reactivation mode when the number of uncompleted jobs is more than ten.

It is seen from FIGS. 9 and 11 that, in the case of color duplex printing, the power consumption in the paper interval expansion mode is smaller than that in the reactivation mode when the number of uncompleted jobs is seven or less, while the power consumption in the paper interval expansion mode is larger than that in the reactivation mode when the number of uncompleted jobs is more than seven.

In FIG. 9, the values of power consumption where the power consumption in the paper interval expansion mode is smaller than that in the reactivation mode are indicated in bold.

When a condition for execution of PPM control is satisfied, engine control unit 152 of image forming apparatus 1 refers to the power consumption transition table for each of the PPM modes to calculate, from the table, the power consumption required for completing printing, and selects a mode in which the power consumption is relatively lower.

When the number of ejected sheets of paper in a color-duplex successive printing process reaches 50, which is a condition for execution of PPM control, engine control unit 152 makes an inquiry to controller unit 150 about information as to uncompleted jobs. When the number of uncompleted jobs is five sheets of paper, the power consumption calculated by means of the power consumption transition table in FIG. 9 is as follows. Namely, the power consumption when PPM control is performed in the paper interval expansion mode is 1509 [W] and the power consumption when PPM control is performed in the reactivation mode is 1773 [W]. Therefore, engine control unit 152 selects the paper interval expansion mode in which the power consumption is relatively lower.

When the number of uncompleted jobs is ten sheets of paper, the power consumption calculated by means of the power consumption transition table in FIG. 9 is as follows. Namely, the power consumption when PPM control is performed in the paper interval expansion mode is 3017 [W] and the power consumption when PPM control is performed in the reactivation mode is 2829 [W]. Therefore, engine control unit 152 selects the reactivation mode in which the power consumption is relatively lower.

The method for calculation using such a table is given by way of example. Another method may be as follows, for example. As shown in FIG. 12, the power consumption required for separating sheets of paper from each other for simplex printing and duplex printing in each of color printing and monochrome printing may be stored in advance and, as shown in FIG. 13, the power consumption required for stopping loads for simplex printing and duplex printing in each of color printing and monochrome printing may be stored in advance. Then, each time a condition for execution of PPM control is satisfied, the power consumption in each mode may be calculated based on information about uncompleted jobs.

In the case where postprocessing apparatus FS is connected to image forming apparatus 1, the power consumption additionally including the power consumption of postprocessing apparatus FS in each mode is measured in advance, and a power consumption transition table prepared based on the measurements is used.

FIG. 14 is a diagram showing a specific example of the power consumption transition table in which the power consumption additionally includes the power consumption of postprocessing apparatus FS. Specifically, there is shown the specific example of the power consumption transition table in the case where so called "straight paper ejection" is done, namely paper is ejected without postprocessing in postprocessing apparatus FS. Here, like FIG. 9, the power consumption in the paper interval expansion mode and the power consumption in the reactivation mode are registered for each of monochrome duplex printing and color duplex printing, for each number of sheets to be ejected after a condition for executing PPM control is met.

Figure 15:
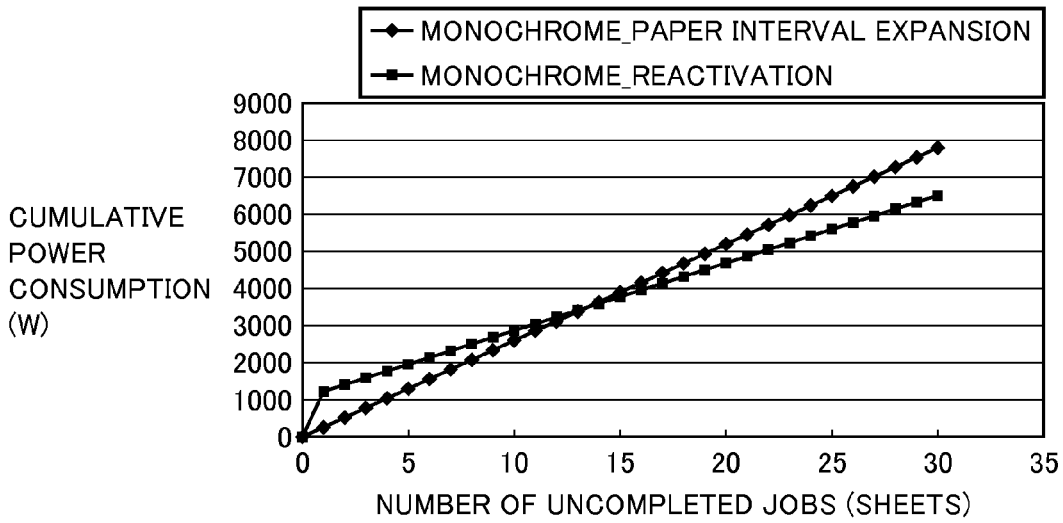
FIG. 15 is a diagram showing a relation, based on FIG. 14, between the number of uncompleted jobs (number of sheets of paper to be ejected after a condition for execution is satisfied) and power consumption in each mode in the case of monochrome duplex printing.
Figure 16:
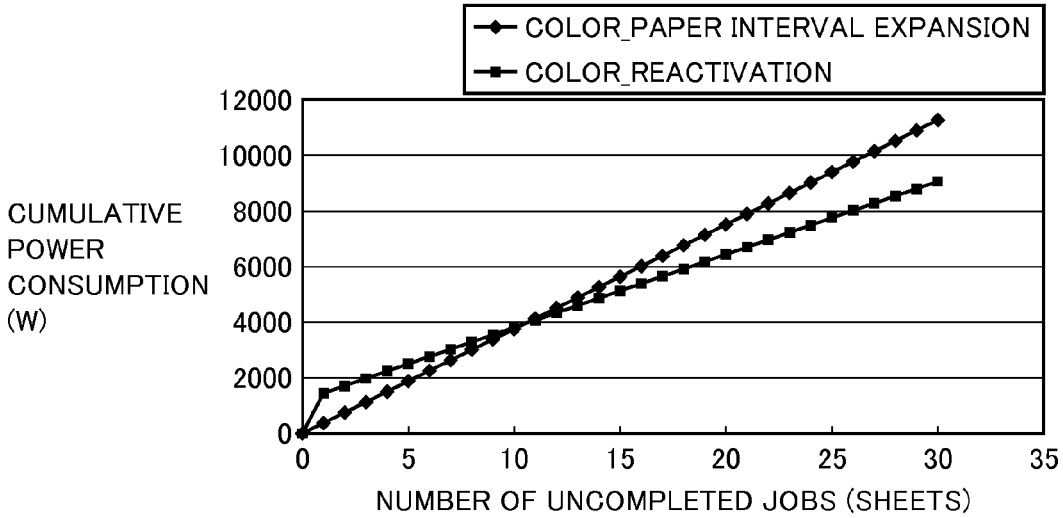
FIG. 16 is a diagram showing a relation, based on FIG. 14, between the number of uncompleted jobs (number of sheets of paper to be ejected after a condition for execution is satisfied) and power consumption in each mode in the case of color duplex printing.

FIG. 15 is a diagram showing a relation, based on FIG. 14, between the number of uncompleted jobs (number of sheets of paper to be ejected after a condition for execution of PPM control is satisfied) and power consumption in each mode in the case of monochrome duplex printing. FIG. 16 is a diagram showing a relation, based on FIG. 14, between the number of uncompleted jobs (number of sheets of paper to be ejected after a condition for execution of PPM control is satisfied) and power consumption in each mode in the case of color duplex printing.

It is seen from FIGS. 14 and 15 that, in the case of monochrome duplex printing, the power consumption in the paper interval expansion mode is smaller than that in the reactivation mode when the number of uncompleted jobs is 13 or less, while the power consumption in the paper interval expansion mode is larger than that in the reactivation mode when the number of uncompleted jobs is more than 13.

It is seen from FIGS. 14 and 16 that, in the case of color duplex printing, the power consumption in the paper interval expansion mode is smaller than that in the reactivation mode when the number of uncompleted jobs is ten or less, while the power consumption in the paper interval expansion mode is larger than that in the reactivation mode when the number of uncompleted jobs is more than ten.

In FIG. 14, the values of power consumption where the power consumption in the paper interval expansion mode is smaller than that in the reactivation mode are indicated in bold.

When a condition for execution of PPM control for color duplex is met and the number of uncompleted jobs is five sheets of paper at this time, the power consumption calculated by means of the power consumption transition table in FIG. 14 is as follows. Namely, the power consumption when PPM control is performed in the paper interval expansion mode is 1871 [W] and the power consumption when PPM control is performed in the reactivation mode is 2475 [W]. Therefore, engine control unit 152 selects the paper interval expansion mode in which the power consumption is relatively lower.

When the number of uncompleted jobs is 11 sheets of paper, the power consumption calculated by means of the power consumption transition table in FIG. 14 is as follows. Namely, the power consumption when PPM control is performed in the paper interval expansion mode is 4117 [W] and the power consumption when PPM control is performed in the reactivation mode is 4047 [W]. Therefore, engine control unit 152 selects the reactivation mode in which the power consumption is relatively lower.

Figures 17, 18, 19:
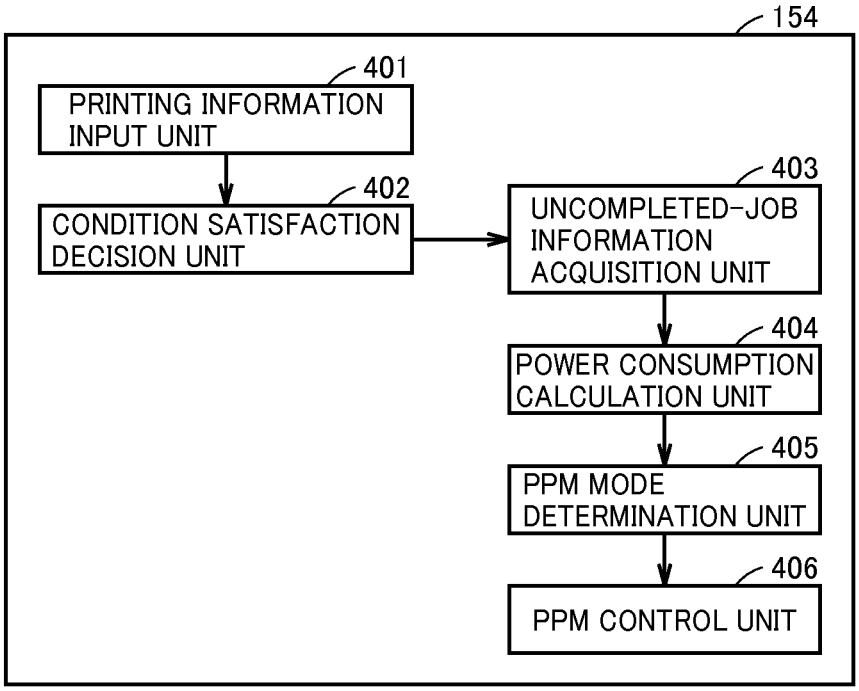
FIG. 17 is a diagram showing a specific example of a power consumption table in which power consumption is defined that is required for separating sheets of paper from each other for simplex printing and duplex printing in each of color printing and monochrome printing.
FIG. 18 is a diagram showing a specific example of a power consumption table in which power consumption is defined that is required for stopping loads for simplex printing and duplex printing in each of color printing and monochrome printing.
FIG. 19 is a block diagram showing a specific example of a functional configuration of the image forming apparatus.

The method for calculation may also be as follows, for example, like the above-described one. As shown in FIG. 17, the power consumption required for separating sheets of paper from each other for simplex printing and duplex printing in each of color printing and monochrome printing may be stored in advance by engine control unit 152 and, as shown in FIG. 18, the power consumption required for stopping loads for simplex printing and duplex printing in each of color printing and monochrome printing may be stored in advance by engine control unit 152. Then, each time a condition for execution of PPM control is satisfied, the power consumption in each mode may be calculated based on information about uncompleted jobs.

Depending on whether postprocessing apparatus FS is connected to image forming apparatus 1 or not, engine control unit 152 selects one of the power consumption transition table in FIG. 9 and the power consumption transition table in FIG. 14 to calculate the power consumption.

<Functional Configuration>

FIG. 19 is a block diagram showing a specific example of a functional configuration of image forming apparatus 1 for performing the above-described operation. Each of the functions in FIG. 19 is implemented chiefly in CPU 154 included in engine control unit 152. Namely, CPU 154 reads a program stored in nonvolatile memory 156 and executes the program. However, at least a part of the functions may be implemented in the configurations shown in FIGS. 1 to 4.

Referring to FIG. 19, CPU 154 includes a printing information input unit 401 for accepting input of printing information such as the number of sheets of paper to be printed, the printing mode, and the like, from controller unit 150, a condition satisfaction decision unit 402 storing the conditions for execution of PPM control in FIG. 5 for deciding whether or not a condition for execution of PPM control is satisfied, an uncompleted-job information acquisition unit 403 for acquiring uncompleted-job information, namely information about uncompleted jobs, from controller unit 150, a power consumption calculation unit 404 for calculating the power consumption in each of the PPM control modes (paper interval expansion mode and reactivation mode) required for completing printing of the uncompleted jobs, by means of the power consumption transition table or the like in FIG. 9 or FIG. 14, a PPM mode determination unit 405 making a comparison of the power consumption for thereby determining the PPM control mode to be executed, and a PPM control unit 406 for controlling controller unit 150 so that PPM control is performed in accordance with the determined mode.

<Operation Flow>

Figure 20:
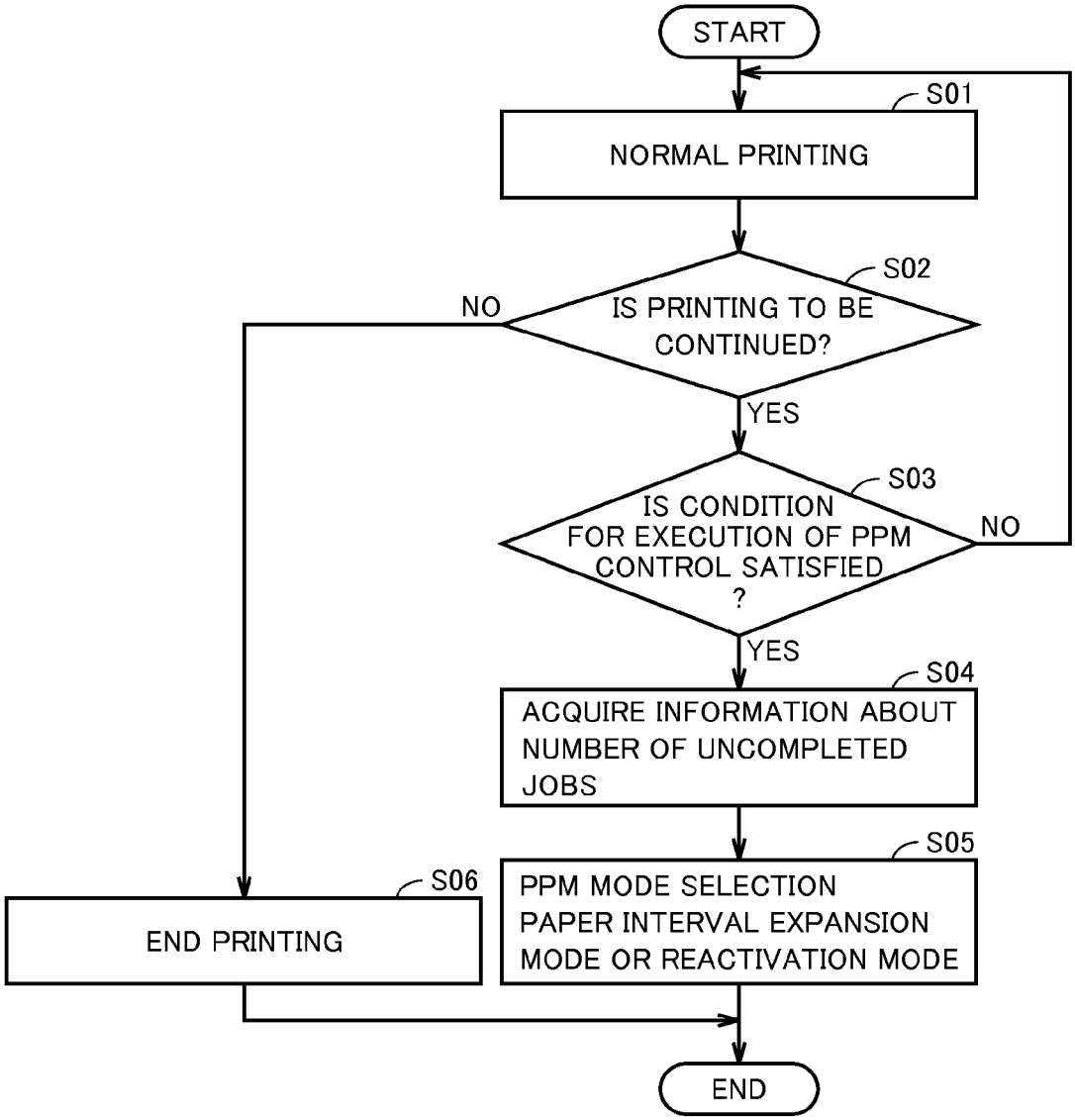
FIG. 20 is a flowchart illustrating an operation in the image forming apparatus.

FIG. 20 is a flowchart illustrating an operation in image forming apparatus 1. The flowchart of FIG. 20 is implemented in the following manner. Namely, CPU 154 included in engine control unit 152 reads a program stored in nonvolatile memory 156 and executes the program to thereby implement respective functions in FIG. 19.

Referring to FIG. 20, while a normal printing operation is continued, CPU 154 continues determining whether or not a condition for execution of PPM control is satisfied (steps S01 to S03). Namely, when the normal printing operation is to be continued (YES in step S02), CPU 154 compares printing information such as the number of sheets of paper to be printed and the printing mode obtained from controller unit 150, with the conditions for execution of PPM control in FIG. 5, so as to determine whether or not each condition for execution of PPM control is satisfied. When the normal printing operation is to be ended (NO in step S02), CPU 154 ends the printing operation (step S06).

When it is determined that a condition for execution of PPM control is satisfied (YES in step S03), CPU 154 acquires uncompleted-job information from controller unit 150 (step S04) and selects a mode of PPM control (step S05).

In step S05, CPU 154 calculates the power consumption in each mode, from the number of sheets to be ejected, which is indicated by the uncompleted-job information, after the condition for execution of PPM control is satisfied, and from the current operation mode (color/monochrome, simplex/duplex) and makes a comparison of the power consumption, to accordingly select a mode in which the power consumption is relatively smaller.

At this time, CPU 154 may also take it into consideration whether or not postprocessing apparatus FS is connected.

<Effects of the Embodiment>

The above-described operation can be performed in image forming apparatus 1 to thereby reduce the power consumption of the printing operation under PPM control after a condition for execution of PPM control is satisfied.

<First Modification>

A first modification will be described in connection with an operation after PPM control is started. After starting PPM control, image forming apparatus 1 selects a PPM mode again.

Figure 21:
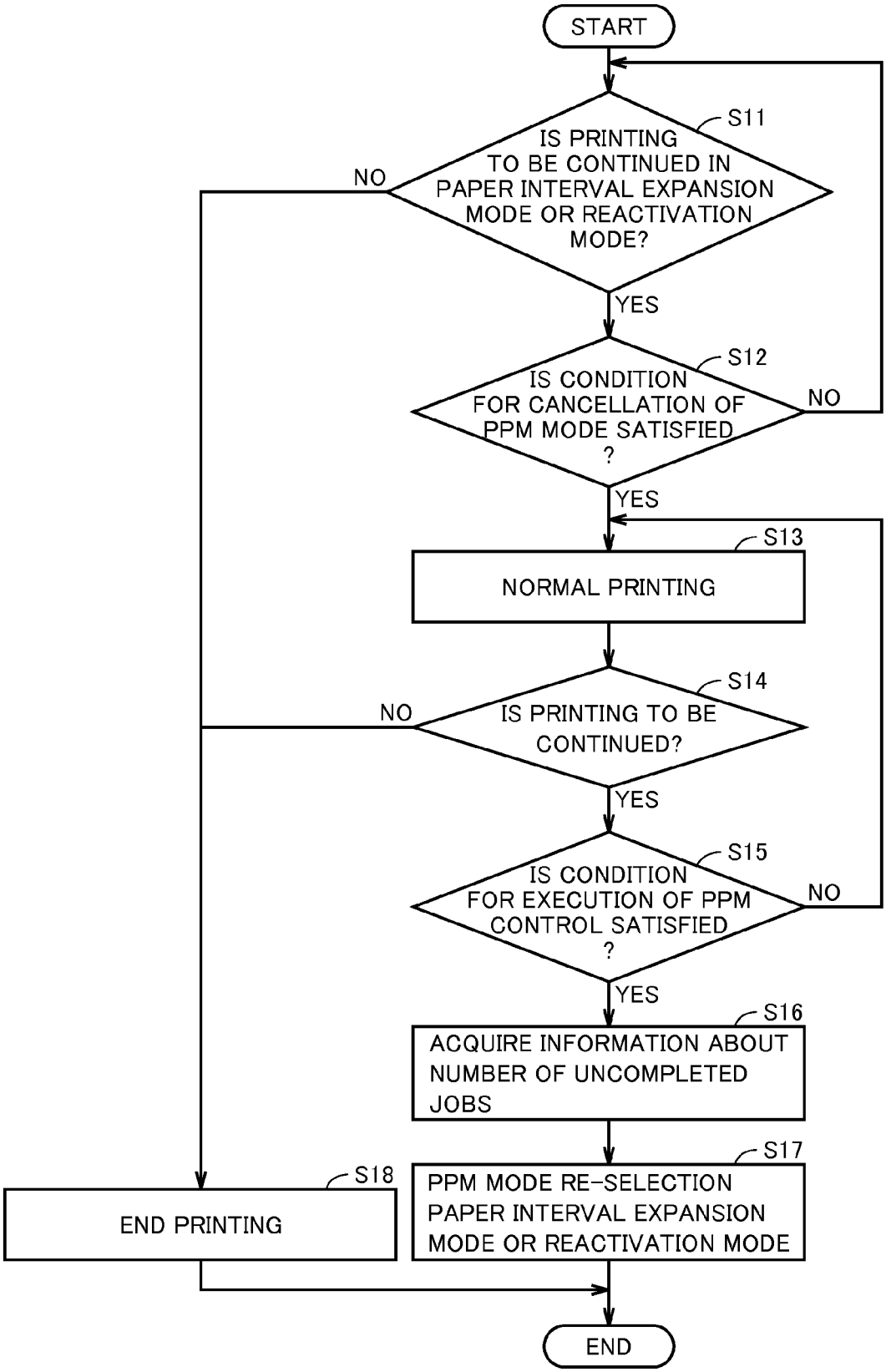
FIG. 21 is a flowchart illustrating an operation in the image forming apparatus in a first modification.

FIG. 21 is a flowchart illustrating an operation in image forming apparatus 1 in the first modification.

Referring to FIG. 21, CPU 154 confirms whether or not the printing operation in any PPM mode is to be continued. When the printing operation is not to be continued (NO in step S11), CPU 154 directly ends the printing operation (step S18).

When the printing operation is to be continued (YES in step S11), CPU 154 confirms whether or not a condition for cancelling PPM control (condition for cancellation) is satisfied while the printing operation is continued in any of the PPM modes.

The condition for cancellation is, in the case for example of the duplex tacking prevention PPM, the fact that ejected sheets of paper have been removed by a user is detected. The fact that the ejected sheets of paper have been removed by a user is detected, for example, when exit outlet sensor 33*a* detects ON (paper is present) and exit outlet sensor 33*a* thereafter detects OFF (paper is absent) for a predefined time T3 (1 [s] for example).

In the case of the fixing edge temperature increase prevention PPM, the condition for cancellation is the fact that a difference between the temperature of the edge of fixing roller 32*a* detected by fixing edge temperature sensor 32*d* and the temperature of the center of fixing roller 32*a* detected by fixing center temperature sensor 32*e* is a predefined temperature T4 (2° C. for example) or lower.

In the case of the PU sticking prevention PPM, the condition for cancellation is the fact that the interior temperature detected by interior temperature sensor 37 is a predefined temperature T5 (35° C. for example) or lower.

When the condition for cancellation is satisfied (YES in step S12), CPU 154 ends PPM control and switches to a normal printing operation (step S13).

After this, while continuing the normal printing operation, CPU 154 determines whether or not the condition for execution of PPM control is satisfied. When it is satisfied, CPU 154 selects a PPM mode to execute PPM control (steps S14 to S17). This operation is identical to the operation in FIG. 20.

The above-described operation is thus performed in image forming apparatus 1 so that a switch is made to the normal printing operation when PPM control becomes unnecessary, and therefore, the productivity will not be deteriorated.

<Second Modification>

A second modification will be described in connection with a process of selecting a PPM mode with priority given to the productivity.

Image forming apparatus 1 in the second modification calculates, when a condition for execution of PPM control is satisfied, the power consumption in each of the paper interval expansion mode and the reactivation mode based on uncompleted-job information, and also calculates the time to be taken for completing a printing operation in each mode.

It is supposed by way of example that the conditions shown in FIG. 22 are defined. Specifically, a condition for execution of PPM control is defined as the condition that the number of ejected sheets of paper in the duplex printing mode has reached 50. On this condition, PPM control is executed. Further, control is defined as follows. In the paper interval expansion mode, the interval at which sheets of paper are ejected is expanded from 2 [s] to 4 [s]. In the reactivation mode, for every 50 ejected sheets of paper, the apparatus is on standby for 150 [s] including a load inactivation time and a load activation time, and thereafter resumes ejection of sheets of paper.

Under the above condition, in the case where the uncompleted-job information indicates 100 (the number of remaining sheets to be printed is 100), the time t1 to be taken for completing printing in the paper interval expansion mode is 400 [s]=100 sheets×4 [s], and the time t2 to be taken for completing printing in the reactivation mode is 500 [s]=100 sheets×2 [s]+150 [s]×2 (times). Thus, the difference in time to be taken for completing printing, between the paper interval expansion mode and the reactivation mode, (t2−t1), is 100 [s].

In the case where the uncompleted-job information indicates 101 (the number of remaining sheets to be printed is 101), the time t1 to be taken for completing printing in the paper interval expansion mode is 404 [s]=101 sheets×4 [s], and the time t2 to be taken for completing printing in the reactivation mode is 652 [s]=101 sheets×2 [s]+150 [s]×3 (times). Thus, the difference in time for completing printing, between the paper interval expansion mode and the reactivation mode, (t2−t1), is 248 [s].

Figure 23:
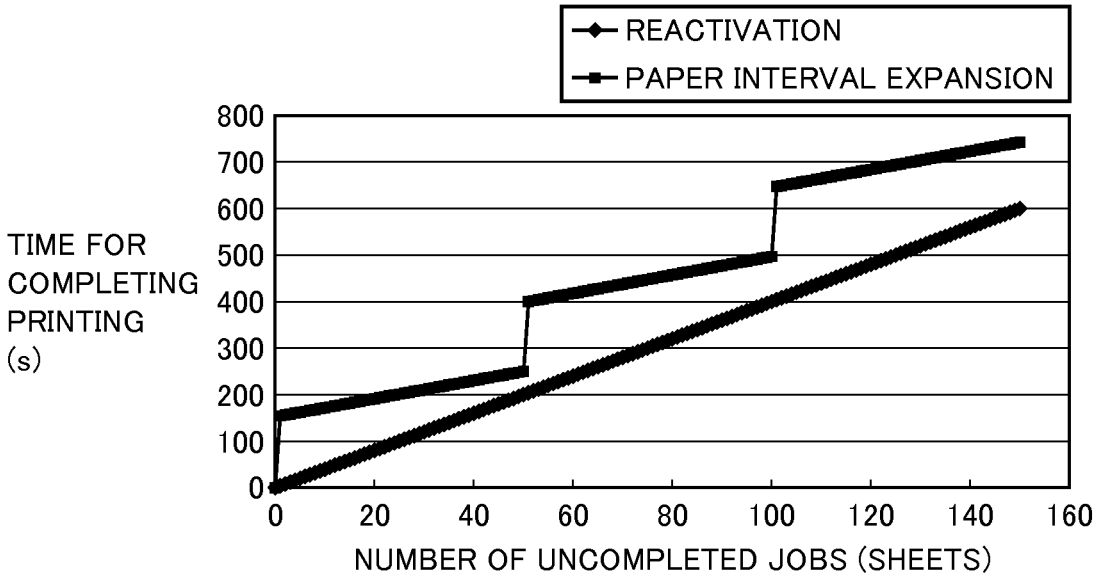
FIG. 23 is a diagram showing, as a transition of the productivity under the conditions in FIG. 22, a relation between the number of uncompleted jobs (number of sheets of paper to be ejected after a condition for execution is satisfied) and the time to be taken for completing printing in each mode.

FIG. 23 is a diagram showing, as a transition of the productivity under the conditions in FIG. 22, specifically a transition of the productivity under the duplex tacking prevention PPM, a relation between the number of uncompleted jobs (number of sheets of paper to be ejected after a condition for execution of PPM control is satisfied) and the time to be taken for completing printing in each mode.

Referring to FIGS. 22 and 23, regarding the reactivation mode, the paper unloading interval is shorter than that of the paper interval expansion mode and therefore the change (slope) of the time to be taken for completing printing which varies depending on the number of uncompleted jobs is accordingly smaller than that of the paper interval expansion mode. Meanwhile, the standby time (150 [s]) is required for every predetermined number of sheets of paper (50 sheets), and accordingly the time to be taken for completing printing increases in a stepwise manner for every 50 sheets of paper. Therefore, regarding the reactivation mode, the productivity significantly deteriorates for every 50 uncompleted jobs, namely sheets of paper.

In view of the above, image forming apparatus 1 in the second modification makes a comparison of the time to be taken for completing printing and the power consumption between the modes of PPM control. When a condition "difference in the time to be taken for completing printing≥predetermined time T6 (180 [s] for example)" is met and a condition "difference in the power consumption for completing printing<predetermined value of electric power W1 (300 [W] for example)" is also met, a mode with higher productivity is preferentially selected. When these conditions are not met, image forming apparatus 1 in the second modification preferentially selects a mode with lower power consumption. The aforementioned predetermined time T6 and predetermined value of electric power W1 may be set or changed by a user through an administrator mode or the like.

Figure 24:
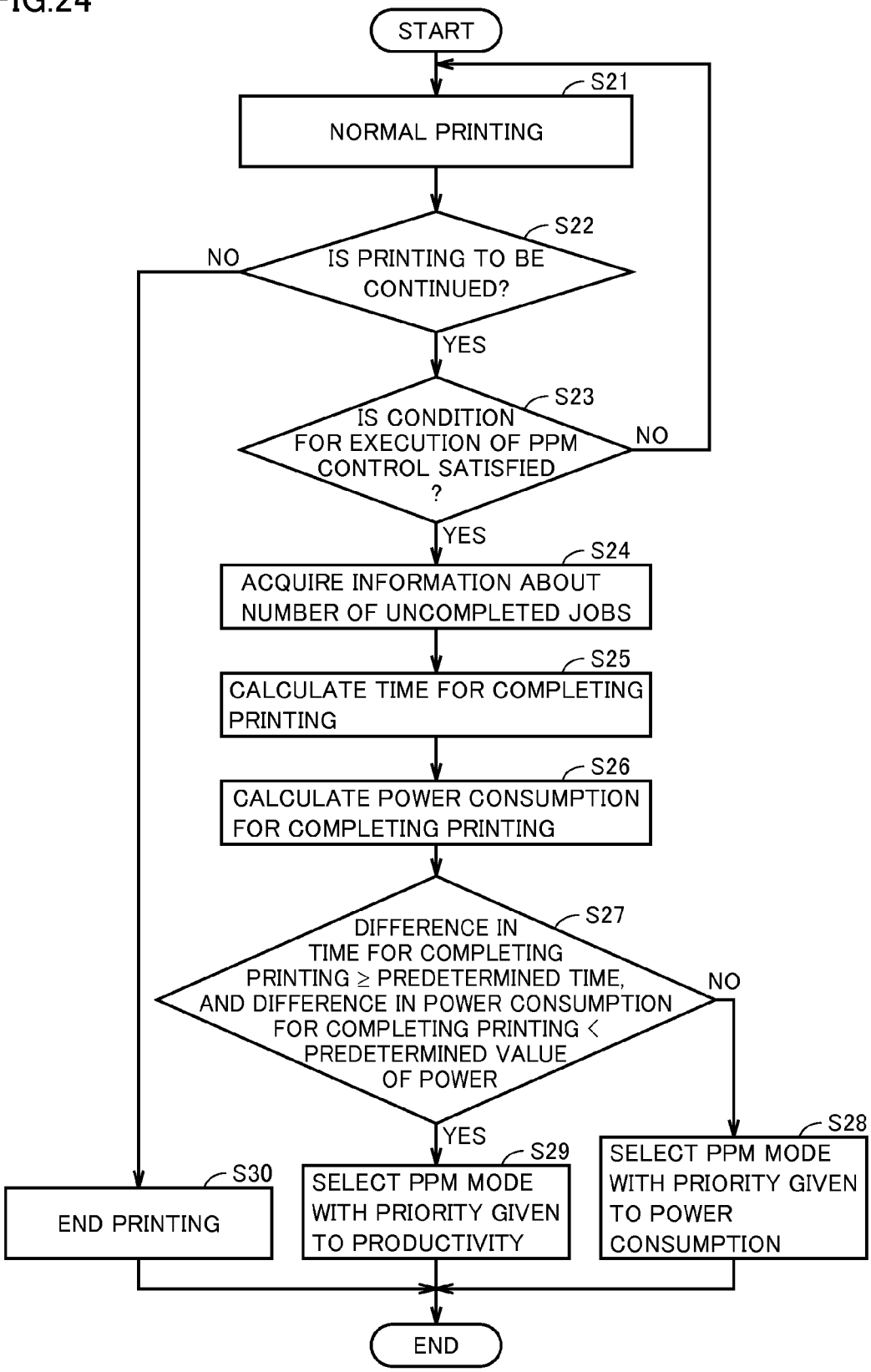
FIG. 24 is a flowchart illustrating an operation in the image forming apparatus in a second modification.

FIG. 24 is a flowchart illustrating an operation in image forming apparatus 1 in the second modification.

Referring to FIG. 24, while a normal printing operation is continued, CPU 154 continues determining whether or not a condition for execution of PPM control is satisfied (steps S21 to S23). When the condition for execution is satisfied (YES in step S23), CPU 154 obtains information about uncompleted jobs from controller unit 150 (step S24). When the normal printing operation is to be ended (NO in step S22), CPU 154 ends the printing operation (step S30). The operations in steps S21 to 24 and S30 are identical to those in steps S01 to S04 and S06 in FIG. 20.

In the second modification, CPU 154 calculates, from the information about uncompleted jobs and the current operation mode (color/monochrome, simplex/duplex), the time to be taken for completing printing and the power consumption for completing printing in each mode (steps S25, S26).

CPU 154 makes a comparison of the time to be taken for completing printing and the power consumption between the modes, to determine whether or not a condition "difference in the time to be taken for completing printing≥predetermined time T6 (180 [s] for example)" and a condition "difference in the power consumption for completing printing<predetermined value of electric power W1 (300 [W] for example)" are met. When CPU 154 determines that these conditions are met (YES in step S27), CPU 154 selects a PPM mode with priority given to the productivity, namely selects a mode with higher productivity (step S29). In other words, CPU 154 selects in step S29 a PPM mode in which the time to be taken for completing printing is relatively shorter.

In contrast, when CPU 154 determines that these conditions are not met (NO in step S27), CPU 154 selects a PPM mode with priority given to the power consumption, namely selects a mode with lower power consumption (step S28). In other words, CPU 154 selects in step S28 a mode in which the power consumption for completing printing is relatively smaller.

The above operation is performed in image forming apparatus 1. Accordingly, in the case where the difference, between the modes, of the time for completing printing is large while there is no significant difference of the power consumption between the modes, a PPM mode in which the time for completing printing is shortest is selected with priority given to the productivity. In this case, the effect of the time for completing printing is larger than the effect of the power consumption.

A program for causing CPU 154 of image forming apparatus 1 to execute the above-described processing can further be provided. Such a program can be recorded on a computer-readable recording medium such as flexible disk, CD-ROM (Compact Disk-Read only Memory), ROM (Read Only Memory), RAM (Random Access Memory), and memory card that are given in combination with a computer, and can accordingly be provided in the form of a program product. Alternatively, the program may be provided by being recorded on a recording medium such as hard disk that is incorporated in a computer. The program may also be provided by being downloaded through a network.

The above program may call required modules in a predetermined sequence and at predetermined timings from program modules provided as a part of an operating system (OS) of a computer and cause processing to be performed. In this case, the above-described modules are not included in the program itself, and processing is executed in cooperation with the OS. Such a program that does not include these modules may be included in the above program.

Moreover, the above program may also be provided by being incorporated in a part of another program. In this case as well, the program itself does not include modules included in the aforementioned other program, and processing is executed in cooperation with the other program. Such a program which is incorporated in the other program may also be included the above-described program.

A program product provided here is installed in a program storage unit such as hard disk and executed. The program product includes the program itself and a recording medium on which the program is recorded.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus for transporting sheets of paper at a predetermined interval and forming an image on said sheets of paper, comprising:

a first decision unit for deciding whether a predefined first condition for starting control of said predetermined interval is satisfied;

a determination unit for determining a mode of the control of said predetermined interval;

a control unit for performing the control of said predetermined interval in the mode determined by said determination unit, in response to a decision made by said first decision unit that said first condition is satisfied;

said mode of the control including:

a first mode of prolonging said predetermined interval by suspending a next paper feeding operation, for a predetermined time and for every predetermined number of sheets of paper; and a second mode of prolonging said predetermined interval by expanding the interval of transportation between said paper feeding operations while continuing the transportation; and a first calculation unit for calculating power consumption in each mode from the decision that said first condition is satisfied to completion of uncompleted printing, said determination unit is configured to select a mode in which the power consumption calculated by said first calculation unit is relatively lower.

2. The image forming apparatus according to claim 1, wherein said determination unit is configured to select said second mode when the number of remaining sheets of paper to be printed after the decision that said first condition is satisfied is less than a predetermined number, and is configured to select said first mode when said number of remaining sheets of paper is said predetermined number or more.

3. The image forming apparatus according to claim 1, wherein a postprocessing apparatus is attachable to said image forming apparatus, and in response to the decision that said first condition is satisfied with said postprocessing apparatus attached to said image forming apparatus, said first calculation unit is configured to calculate, as the power consumption in each mode from the decision that said first condition is satisfied to completion of uncompleted printing, the power consumption to which power consumption of said postprocessing unit is added.

4. The image forming apparatus according to claim 1, wherein said first condition includes a condition that a predetermined number or more of printed sheets of paper have been ejected on the same paper ejection tray in a duplex printing mode.

5. The image forming apparatus according to claim 1, wherein said first condition includes a condition that a predetermined number or more of sheets of paper whose length in a main scanning direction is shorter than a predetermined value have successively been printed.

6. The image forming apparatus according to claim 1, wherein said first condition includes a condition that an interior temperature of said image forming apparatus has reached a predetermined value during successive printing.

7. The image forming apparatus according to claim 1, further comprising a second decision unit for deciding whether a predefined second condition for ending the control of said predetermined interval is satisfied, wherein in response to a decision made by said second decision unit that said second condition is satisfied, after start of the control of said predetermined interval, said control unit is configured to end the control of said predetermined interval and said first decision unit is configured to decide whether said first condition is satisfied.

8. The image forming apparatus according to claim 1, further comprising a second calculation unit for calculating a printing time in each said mode required from the decision that said first condition is satisfied to completion of uncompleted printing, wherein said determination unit is configured to select a mode in which said printing time is relatively shorter in response to that a third condition is satisfied and select a mode in which said power consumption is relatively lower in response to that said third condition is not satisfied, said third condition being that a difference, between said first mode and said second mode, of said printing time calculated by said second calculation unit is a predetermined value or more which is set in advance, and a difference, between said first mode and said second mode, of said power consumption calculated by said first calculation unit is less than a predetermined value which is set in advance.

9. A method for controlling an image forming apparatus so that said image forming apparatus transports sheets of paper at a predetermined interval and forms an image on said sheets of paper, said image forming apparatus having, as modes for controlling said predetermined interval, a first mode of prolonging said predetermined interval by suspending a next paper feeding operation, for a predetermined time and for every predetermined number of sheets of paper and a second mode of prolonging said predetermined interval by expanding the interval of transportation between said paper feeding operations while continuing the transportation, said method comprising:

deciding whether a predefined condition for starting control of said predetermined interval is satisfied during normal printing;

determining a mode of the control of said predetermined interval in response to a decision that said condition is satisfied; and performing the control of said predetermined interval in the determined mode, said determining a mode including:

calculating power consumption in each mode from the decision that said condition is satisfied to completion of uncompleted printing; and selecting a mode in which said power consumption is relatively lower.

10. A non-transitory computer-readable storage medium storing a control program for causing a controller of an image forming apparatus to execute a process of transporting sheets of paper at a predetermined interval and forming an image on said sheets of paper, said image forming apparatus having, as modes for controlling said predetermined interval, a first mode of prolonging said predetermined interval by suspending a next paper feeding operation, for a predetermined time and for every predetermined number of sheets of paper and a second mode of prolonging said predetermined interval by expanding the interval of transportation between said paper feeding operations while continuing the transportation, said control program causing said controller of said image forming apparatus to perform:

deciding whether a predefined condition for starting control of said predetermined interval is satisfied during normal printing;

determining a mode of the control of said predetermined interval in response to a decision that said condition is satisfied; and performing the control of said predetermined interval in the determined mode, said determining a mode including:

calculating power consumption in each mode from the decision that said condition is satisfied to completion of uncompleted printing; and selecting a mode in which said power consumption is relatively lower.

* * * * *